United States Patent [19]

Papesch

[11] Patent Number: 4,930,273

[45] Date of Patent: Jun. 5, 1990

[54] MULTILEVEL MODULAR BUILDING WITH SCISSOR STAIRS AND METHOD OF ASSEMBLY

[75] Inventor: Peter P. Papesch, Boston, Mass.

[73] Assignee: Modulex, Inc., Boston, Mass.

[21] Appl. No.: 328,526

[22] Filed: Mar. 24, 1989

Related U.S. Application Data

[63] Continuation-in-part of Ser. No. 216,518, Jul. 6, 1988, abandoned.

[51] Int. Cl.[5] ..... E04F 11/00

[52] U.S. Cl. ..... 52/79.1; 52/185; 52/745

[58] Field of Search ..... 52/79.12, 79.13, 79.14, 52/185, 184, 186, 187, 188, 79.2, 79.3, 79.1, 236.3, 741, 745

[56] References Cited

U.S. PATENT DOCUMENTS 725,179 4/1903 Uehling ..... 52/185
836,172 11/1906 Anderson ..... 52/185
4,364,206 12/1982 Wybauw ..... 52/79.1

FOREIGN PATENT DOCUMENTS 341248 9/1921 Fed. Rep. of Germany ..... 52/185
382425 11/1964 Switzerland ..... 52/185
545734 3/1977 U.S.S.R. ..... 52/190

*Primary Examiner*—John E. Murtagh
*Attorney, Agent, or Firm*—Weingarten, Schurgin, Gagnebin & Hayes

[57] ABSTRACT

A multilevel modular building with scissor stairs and a method for constructing such a building is disclosed. The scissor stair comprises a pair of stairways connecting the floor of a module on a lower level with the floor of a module directly above. The stairways are disposed adjacent to each other in parallel vertical planes and configured in an X shape. A fire wall separates each stairway. In this manner, the stairways of the present invention provide the upper level with two separate and remote routes for access or egress in a minimal amount of space.

25 Claims, 6 Drawing Sheets

MULTILEVEL MODULAR BUILDING WITH SCISSOR STAIRS AND METHOD OF ASSEMBLY

This application is a continuation in part of Application Ser. No. 07/216,518, filed on July 6, 1988, now abandoned.

FIELD OF THE INVENTION

This invention relates to the construction of buildings and, more particularly, to the construction of modular buildings.

BACKGROUND OF THE INVENTION

The construction of buildings from modular elements is an economic method of construction. Each module is prefabricated at a location away from the actual building site in an environment where construction conditions can be controlled and optimized. The modules are then transported to the building site. Assembly at the building site is faster and easier, since most of the on site construction work has been eliminated.

Modules may take a variety of forms. For example, a module may comprise a complete living or working space including a floor, a ceiling, and several walls. One module may encompass several rooms and may even include offset or stepped levels. However, the larger and more complex the module becomes, the more difficult it becomes to transport. Some modules comprise smaller elements, such as T- or H-shaped structural members which are assembled on site into living or working space. However, the smaller and more numerous the modular elements become, the greater the time and labor required at the building site becomes.

One problematic area in modular construction has been the design of efficient stairways. Since stairways function as connectors between levels in a building, it is difficult to incorporate an efficient stairway design into compactly designed modules which themselves occupy only a single level. One approach has been to design a single module with multiple offset levels and short stairways built integrally into the module to connect the levels. Another approach has been to form the stairway itself as an integral prefabricated member, generally of concrete. However, these approaches generally increase the complexity and have not proven to be cost effective. In addition, larger multilevel modules can be difficult to transport due to their larger size. Also, these designs have not made the optimal use of space, an important component in modular design. This is particularly a problem in buildings which must have two separate stairways accessing each level for fire safety. Generally, the two stairways are located in remote areas of the building.

SUMMARY OF THE INVENTION

The present invention provides a modular building and a method for its construction which combines single level building modules and scissor stairs into a multilevel building. The scissor stairs require less space than conventional stairs and are, therefore, especially suitable for modular construction. The scissor stair comprises a pair of stairways, each connecting a floor of a module on a lower level with a floor of a module on an upper level. The stairways are disposed adjacent to each other in parallel vertical planes and run in opposite directions to form an X or scissor configuration.

A firewall separates each stairway. Also, each stairway is generally enclosed by fire resistant sidewalls, floors, and ceilings. Thus, if one stairway becomes inaccessible, for example by filling with smoke during a fire, the other stairway is still available for escape.

Advantageously, the stairways may be built on site after the modules have been assembled. The stairways may be located in the interior of a module, outside a module, or may be shared by two or more modules. In this manner, the present invention optimizes the need for minimal on site construction with simplicity of modular design and ease of transportability.

BRIEF DESCRIPTION OF THE DRAWINGS

The invention will be more fully understood from the detailed description taken in conjunction with the accompanying drawings in which.

DETAILED DESCRIPTION OF THE INVENTION

Figure 1:
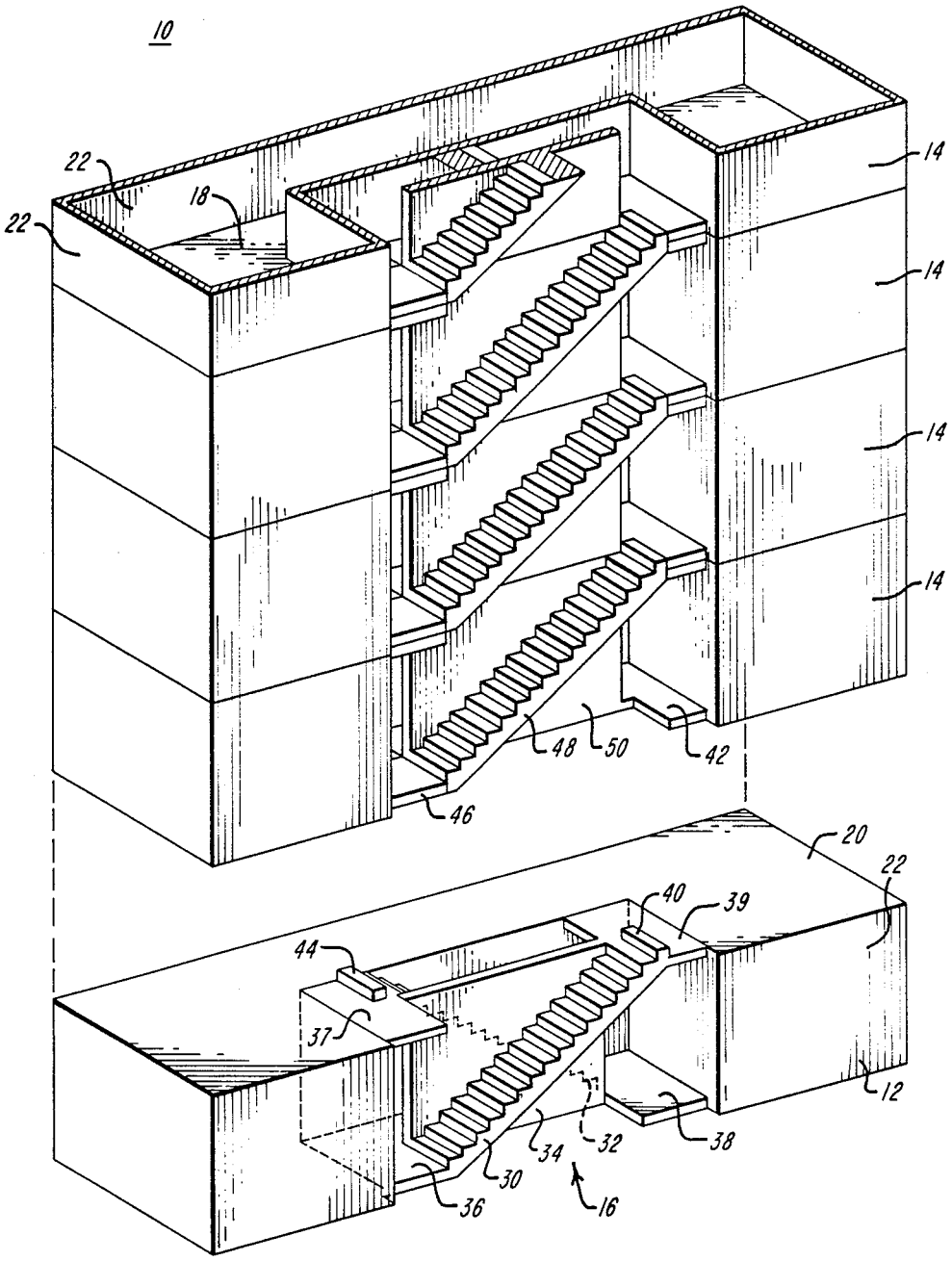
FIG. 1 is a partially exploded perspective view of a modular building according to the present invention.

FIG. 1 shows a multilevel building generally at 10 formed from a plurality of modules. The building comprises a module 12 located on the ground level and any number of modules 14 located at intermediate levels above module 12. A top module is included, but is not shown in FIG. 1. Although not shown, additional modules on each horizontal level could be included as well.

Each module is generally boxlike and comprises a floor 18, a ceiling or roof 20, and walls 22. The modules may be wired or plumbed, for plumbing, heating, air conditioning, oil, gas, electricity, or any other utilities. Also, windows, doors, skylights, hatchways, or other openings (not shown) may be included as desired. Each module is independently prefabricated and transported to a building site.

In the case of a stairway which is prefabricated with the module, the scissor stair of the present invention is shown generally at 16 and is substantially the same for all intermediate modules. As shown in the ground level module 12 in FIG. 1, the scissor stair comprises a pair of identical stairways 30, 32, each connecting the floor of a module on the ground level with the floor of a module on the vertically adjacent level. Each stairway is disposed adjacent to the other in parallel vertical planes. The stairways head in opposite directions so that they form a scissor, X, or cross configuration. A fire resistant wall 34 is positioned between each stairway. Stairway 30 begins at and is structurally formed with landing 36 which is at the same level as the floor 18 of module 12. Similarly, stairway 32 begins at and is structurally a part of landing 38 which is at the same level as the floor 18 of module 12. The top stair 40 of stairway 30 ends at landing 42 of module 14 on the level immediately above. Similarly, the top stair 44 of stairway 32 ends at landing 46 of module 14. In the prefabricated stair and module, steps 40 and 44 are fitted and finished with on site material to fit smoothly with and by the flooring from the module above. The structure is secured with either floor-to-floor or floor-to-ceiling support. Intermediate level 14 has a similar configuration of the scissor stair. Stairway 48 rises from landing 46 to the floor level at the level above. Another stairway (not shown) on the other side of fire resistant wall 50 rises from landing 42 in the opposite direction.

The scissor stair does not need to be prefabricated into the module; it may be built on site if desired. Often, this is the preferred method of constructing a modular building of the present invention, because the stairways must extend above the ceiling level of a lower module to the floor level of an upper module. If the scissor stair is to be located within the interior of the modules, as shown in FIG. 1, the modules may be prefabricated with a space into which the stairways are built on site. The stairways may be attached to the modules in any suitable manner. Preferably, the stairways are supported by the modules on both the lower and upper levels. Alternatively, the stairways may be supported entirely by one or more modules on the lower level or entirely by one or more modules on the upper level.

Landings 36, 38, 42, 46 may be prefabricated within the modules or they may be constructed later on site as the stairways are constructed. Similarly, ceiling members 37, 39 may be prefabricated within the modules or may be constructed later on site. All landings, ceiling members, and surrounding walls are fire resistant, so that each stairway can be isolated from the other stairway in case of a fire.

Figure 2:
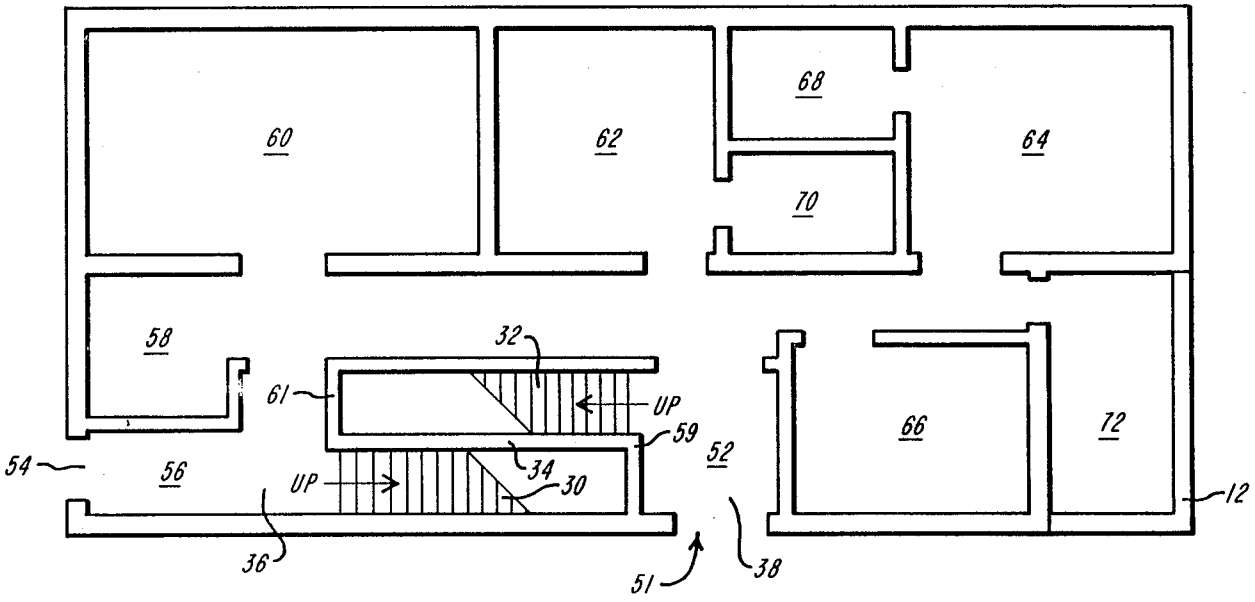
FIG. 2 is a floor plan of a module on the ground level according to the present invention.
Figure 3:
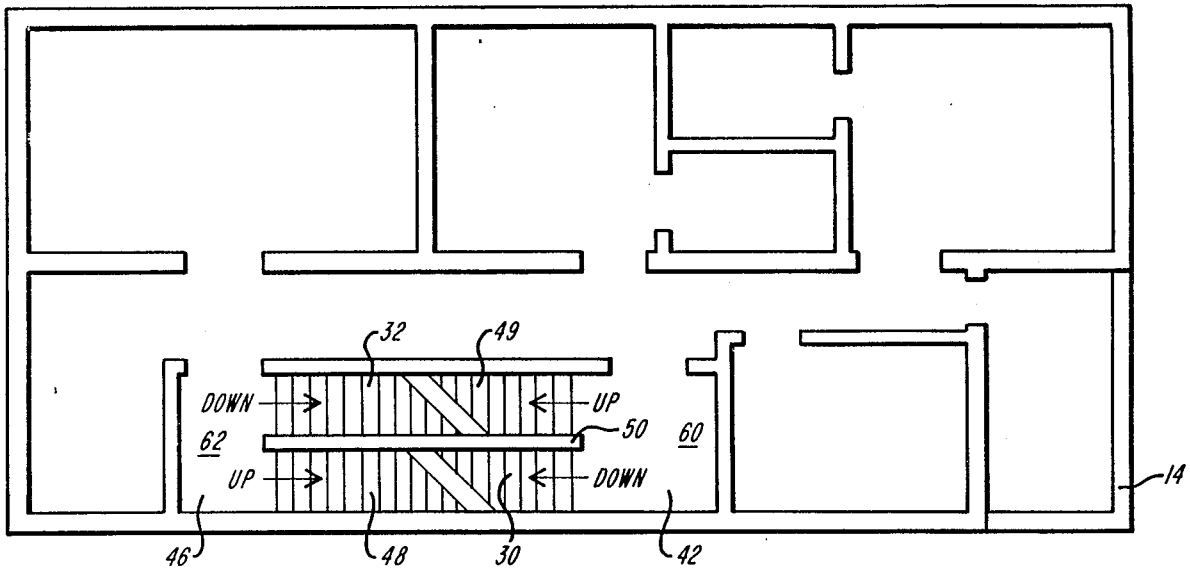
FIG. 3 is a floor plan of a module on an intermediate level according to the present invention.
Figure 4:
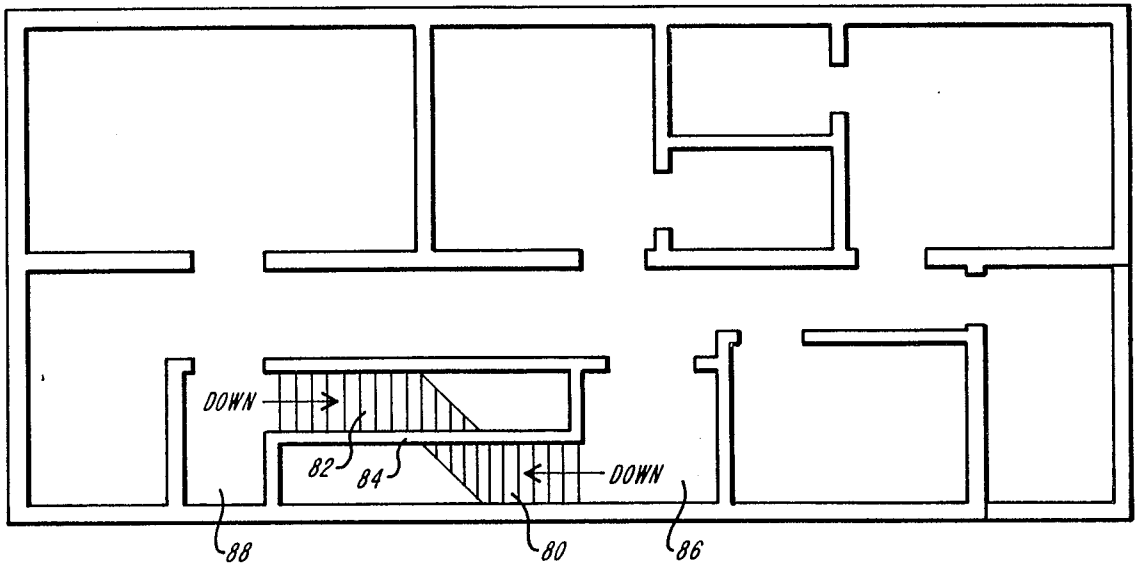
FIG. 4 is, a floor plan of a module on the top level according to the present invention.

FIGS. 2–4 show representative floor plans of the ground level, intermediate level, and top level modules, respectively of FIG. 1. Each level typically represents a self-contained living or working unit having two entrances. For example, FIG. 2 shows a ground or entry level module having a first building entrance 51, first foyer 52, second building entrance 54 and second foyer 56. Rooms could, for example, include a kitchen 58, living and dining rooms 60, bedrooms 62, 64, 66, bathrooms 68, 70, and deck 72. Although FIG. 2 shows the floor plan as comprising a single module, it could also comprise two or more modules. For example, rooms 60, 62, 68, 70, and 64 could comprise one module and rooms 58, 66, deck 72, and the space for the scissor stair could comprise another module.

The foyers serve as common access areas for the entire building. Fire resistant doorways between foyers 52 and 56 and the rest of the living area can be used to close off the living area from the foyers. Stairways 30, 32 provide access to the upper units. If desired, a basement level could be included and suitable scissor stairs could be used to access the basement. In that case, walls 59, 61 would not be used to close off the stairways, but foyers 52 and 56 would normally be separated from the basement by fire resistant doorways.

FIG. 3 is a representative floor plan of an intermediate level module. The room layout as shown is similar to that in FIG. 2, although it may be different if desired. Stairways 30 and 32 rise from the lower level. Stairways 48 and 49, separated by firewall 50, rise to the next level. Foyer area 60 serves stairways 30 and 49. Foyer area 62 serves stairway 32 and 48. Each foyer area may be closed off from the living or working space in the module with suitable fire resistant doors. Thus, the module on the intermediate level is served by two separate and remote exits or entrances.

FIG. 4 is a representative floor plan of a module on the top level of a building. Stairways 80 and 82, separated by fire resistant wall 84, lead down to the next lower level. Foyer area 86 serves stairway 80. Foyer area 88 serves stairway 82. Each foyer area may be closed off from the living or working space in the module with suitable fire resistant doors. Thus, the module on the top level is served by two separate and remote entrances or exits.

In all of the above configurations of the scissor stair, each stairway is enclosed by fire resistant walls, ceilings, floors, and doors. The inclined undersurface of a stairway may serve as the ceiling of the stairway directly below. During a fire, each stairway is isolated from the other, providing two separate routes for exiting from each level.

Figure 5:
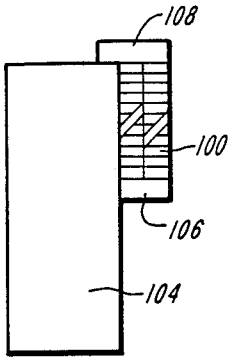
FIGS. 5–9 are schematic plan views of alternative embodiments of a modular building according to the present invention.

FIGS. 1–4 show the scissor stair incorporated within the interior of a module. As shown schematically, in FIGS. 5–11, the scissor stairway of the present invention may connect the modules in a wide variety of configurations. Each module in FIGS. 5–9 is representative of a plurality of vertically stacked modules. In FIG. 5, the scissor stair 100 is located exteriorally of module 104. Access to the module is provided at landings 106, 108.

Figure 6:
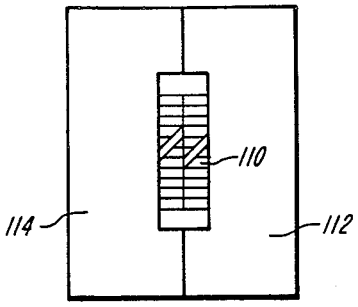
Figure 7:
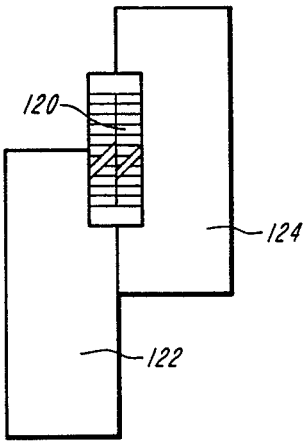
Figure 10:
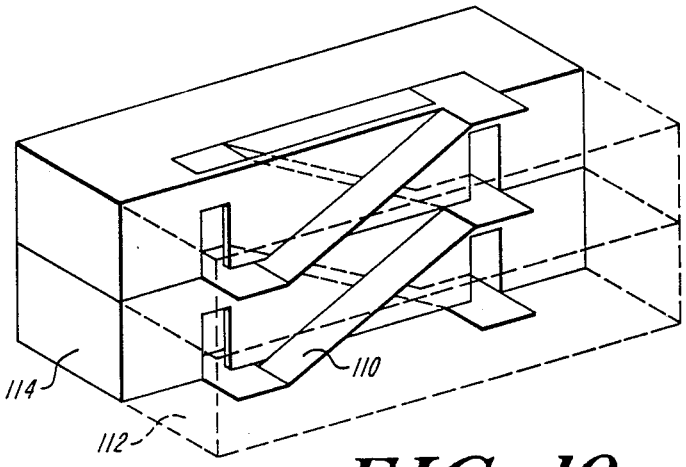
FIG. 10 is a schematic perspective view of the embodiment of FIG. 6.

FIG. 6 shows an embodiment in which horizontally adjacent modules 112, 114 share the scissor stair 110. FIG. 10 shows this embodiment in a perspective schematic view. FIG. 7 is a further embodiment in which one stairway of the scissor stair 120 is located partially outside of modules 122, 124 while still serving each level with two separate and remote entrances or exits.

Figure 8:
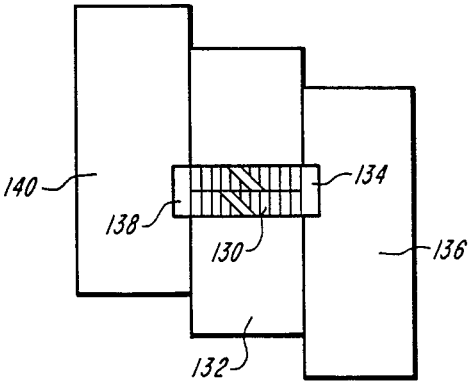
Figure 11:
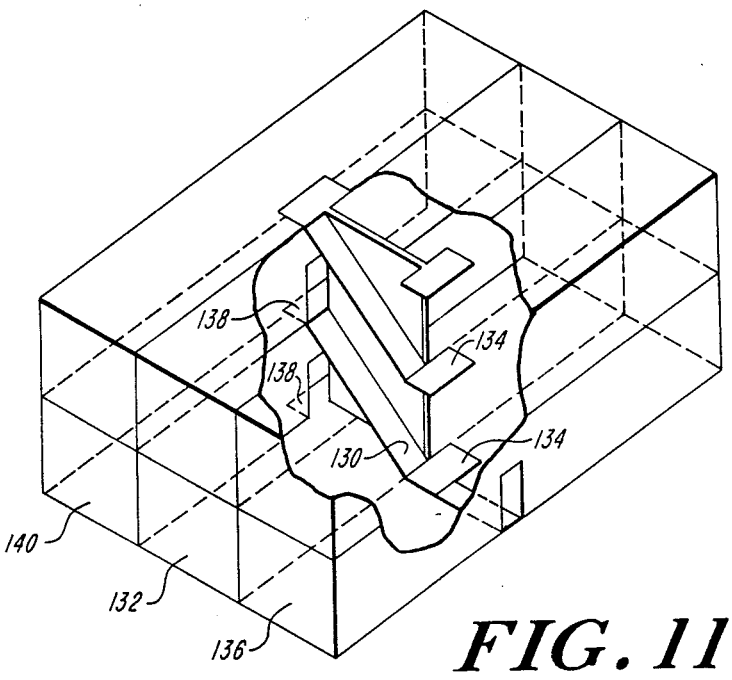
FIG. 11 is a schematic perspective view of the embodiment of FIG. 8.

FIG. 8 shows a further embodiment in which scissor stair 130 extends through a center module 132. Landing 134 is located in module 136. Landing 138 is located in module 140. Suitable doorways (not shown) may be provided between modules 132, 136, and 140 on a single level to allow access to either stairway from any point on a level. FIG. 11 is a perspective view of the embodiment of FIG. 8 (with modules 132, 136 and 140 shown aligned rather than offset as in FIG. 8). Each module 132, 136, 140 is representative of a plurality of vertically stacked modules. Scissor stair 130 and landings 134, 138 are provided on each level. In this manner, each level has two separate and remote entrances or exits.

Figure 9:
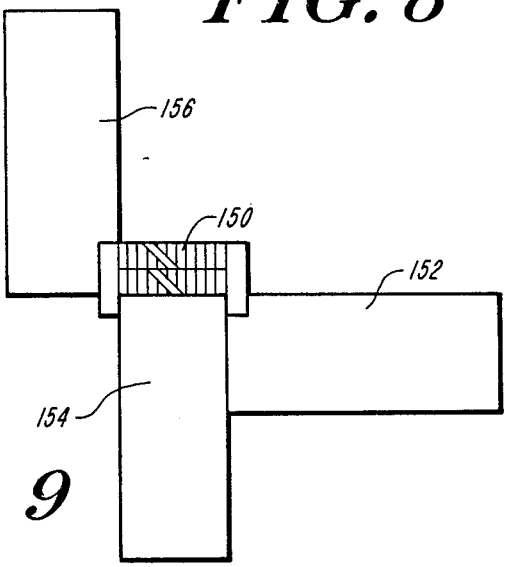

FIG. 9 is a further embodiment, similar to the embodiment of FIG. 8, in which scissor stair 150 is located exteriorally of three modules 152, 154, 156. Other configurations are contemplated as well.

The invention is not to be limited by what has been particularly shown and described, except as indicated by the appended claims.

I claim:

1. A modular building comprising:

a plurality of modules, each module comprising a floor, a ceiling, and walls, some of the plurality of modules disposed in a lower level and others of the plurality of modules disposed in an upper level vertically adjacent to the lower level to form a module stack; and pairs of stairways installed into said module stack and connected to and extending between the floors of the modules on the lower level and the floors of the modules on the upper level, each pair of stairways disposed adjacently in parallel vertical planes and configured in an X shape, each stairway of each pair comprising a single flight of stairs and providing a separate access to the modules on the upper level.

2. The modular building of claim 1 further comprising an opening in a ceiling level of the modules on the lower level directly above each stairway to provide the access to the stairway from the modules on the upper level.

3. The modular building of claim 2 further comprising an opening in a floor level of the modules on the upper level cooperative with the opening in the ceiling level of the modules on the lower level to provide access to the stairway from the modules on the upper level.

4. The modular building of claim 1 wherein the stairways are supported at the ceiling of the lower modules.

5. The modular building of claim 1 wherein the stairways are supported at the floor of the upper modules.

6. The modular building of claim 1 further comprising a fire resistant wall disposed between the stairways of each pair of stairways.

7. The modular building of claim 6 further comprising:

fire resistant walls and ceilings surrounding each stairway of each pair of stairways to isolate each stairway from the other stairway.

8. A modular building comprising:

at least a lower module and an upper module, each module formed off site and assembled on site to be vertically adjacent to each other, each module having a floor, a ceiling, and walls;

a first stairway comprising a single flight of stairs disposed in a first vertical plane in the lower module, providing a first access to the upper module;

a second stairway comprising a single flight of stairs disposed in the lower module adjacent to the first stairway and in a second vertical plane parallel to the first plane, the first stairway and the second stairway together configured to form an X shape, the second stairway providing a second access to the upper module; and wherein the first and second stairways are connected to and extend between the floor of the lower module and the floor of the upper module.

9. The modular building of claim 8 wherein the first and second stairways are supported at the ceiling of the lower module.

10. The modular building of claim 9 wherein the first and second stairways are attached to the ceiling of the lower module on site.

11. The modular building of claim 9 wherein the first and second stairways are attached to the ceiling of the lower module off site.

12. The modular building of claim 8 wherein the first and second stairways are supported at the floor of the upper module.

13. The modular building of claim 12 wherein the first and second stairways are attached to the floor of the upper module on site.

14. The modular building of claim 8 wherein the first and second stairways are attached to the floor of the upper module off site.

15. The modular building of claim 8 wherein the first and second stairways are attached on site at the ceiling of the lower module.

16. The modular building of claim 8 wherein the first and second stairways are attached off site at the ceiling of the lower module.

17. The modular building of claim 8 further comprising a fire resistant wall disposed between the first stairway and the second stairway.

18. The modular building of claim 17 further comprising fire resistant walls and ceilings surrounding each stairway of each pair of stairways to isolate each stairway from the other stairway.

19. A method of constructing a building, the building comprising a plurality of modules of generally box-like configuration, the modules arrayed in at least two vertically adjacent levels to form a module stack defining at least a first floor level and a second floor level, upper levels having at least two separate and remote means for egressing, the method comprising:

constructing the plurality of modules off site independently of each other;

placing a first module at a building site;

placing a second module in the level vertically adjacent to the first module to form the module stack;

installing on site a first stairway in the module stack, in a first vertical plane, connecting to and extending between the first floor level and the second floor level, the first stairway comprising a single flight of stairs; and installing on site a second stairway in the module stack, adjacent to the first stairway in a second vertical plane parallel to the first plane to form an X configuration, connecting to and extending between the first floor level and the second floor level, the second stairway comprising a single flight of stairs.

20. The method of claim 19 wherein the step of constructing the plurality of modules includes constructing off site the first stairway and the second stairway within the first module.

21. The method claim 20 wherein the steps of providing the first stairway and providing the second stairway each includes the step of attaching on site the respective stairway to the second module at the second floor level.

22. The method of claim 19 wherein the steps of providing the first stairway and providing the second stairway each comprise the step of building the respective stairway at the building site.

23. The method of claim 19 further comprising the step of transporting the plurality of modules to the building site.

24. The method of claim 19 further including the step of providing a fire resistant wall between the first stairway and the second stairway.

25. The method of claim 24 further including the step of providing fire resistant walls and ceilings surrounding the first stairway and surrounding the second stairway to isolate the first and second stairways from each other.

* * * * *